US005595451A

United States Patent [19]

Harrison, Jr.

[11] Patent Number: 5,595,451

[45] Date of Patent: Jan. 21, 1997

[54] PAINTING APPARATUS AND METHODS

[75] Inventor: William E. Harrison, Jr., Norman, Okla.

[73] Assignee: Dunlap & Codding, P.C., Oklahoma City, Okla.

[21] Appl. No.: 485,345

[22] Filed: Jun. 7, 1995

[51] Int. Cl.[6] ..... B05C 17/035

[52] U.S. Cl. ..... 401/219; 401/136; 401/208

[58] Field of Search ..... 401/219, 208, 401/140, 136

[56] References Cited

U.S. PATENT DOCUMENTS

| | | | |
|---|---|---|---|
| 995,017 | 6/1911 | Keevil | 239/271 |
| 2,683,626 | 7/1954 | Wahlin | 239/565 |
| 2,696,449 | 12/1954 | Ericks et al. | 118/313 |
| 3,561,398 | 2/1971 | Rose et al. | 239/69 |
| 3,885,066 | 5/1975 | Schwenninger | 118/315 |
| 4,059,358 | 11/1977 | Arai | 401/219 |
| 4,140,410 | 2/1979 | Garcia | 401/219 X |
| 4,465,714 | 8/1984 | Petro, IV | 118/313 |
| 5,295,626 | 3/1994 | Mirabito | 239/526 |
| 5,364,198 | 11/1994 | Skenderi | 401/140 X |

FOREIGN PATENT DOCUMENTS

| | | | |
|---|---|---|---|
| 2914030 | 10/1979 | Germany | 401/219 |
| 427587 | 6/1967 | Switzerland | 401/219 |
| 1306785 | 2/1973 | United Kingdom | 239/154 |

OTHER PUBLICATIONS

Titan Tool Inc "Spray Roll Application Kit" 1986.

*Primary Examiner*—Steven A. Bratlie
*Attorney, Agent, or Firm*—Dunlap & Codding, P.C.

[57] ABSTRACT

A painting apparatus having a spray gun connected to one end of an extension handle, both a roller and a spray nozzle having a plurality of nozzles connected to the opposing end of the extension handle, the spray gun connected to the spray nozzle via a connecting hose. The painting apparatus permits an operator to adjust the spray pattern of a composition such that the composition is disposed on a surface, the roller, or both.

4 Claims, 3 Drawing Sheets

PAINTING APPARATUS AND METHODS

BACKGROUND OF THE INVENTION

1. Field of the Invention

This invention generally relates to apparatus for applying materials or compositions to a surface, and, more particularly, to apparatus for applying paint to a surface or item, and the methods of using same.

2. Background Information

Spray nozzles, spray guns, and rollers have been developed for applying various compositions to a surface and/or to an item. Spray guns have been developed which permit rapid application of a composition such as, paint, to a surface. Such spray guns are more time efficient than when a painter uses either a roller or a brush to cover the same surface. Spray nozzles have been adapted to connect to such spray guns. Spray nozzles have been used for many years to spray various paint compositions, because the paint sprayed from a spray nozzle covers a broader surface more rapidly than use of a roller or a brush. Spray guns having spray nozzles connected thereto are known in the art, and commercially available. Yet, spray guns and/or spray nozzles may not use paint as efficiently, or coat some surfaces as smoothly and evenly, as a roller.

Rollers have been used for years, and are still being used to apply and/or spread paint across a surface and/or item. The use of a roller permits a painter to smooth the paint across the selected surface and/or item evenly, eliminates drip marks, and may, in some applications, more efficiently use the paint. Using rollers, however, to apply paint to a surface is very time consuming.

Further, it will be appreciated that paint is sometimes applied to a surface above the painter's head, and beyond his reach. Often, an extension handle, with a roller on the end thereof, is used. Such extensions permit a painter to apply paint to a surface beyond his reach. Such extensions have presently only been available to be used with a roller or a paint brush, or the like. In these instances, when extensions are being used, the painter must stop, after rolling the roller across a section of a surface and/or item several times, to put more paint on the roller. Again, this step is time consuming. A means of coating a surface beyond a painter's reach using an extendable handle which connects to a generic, commercially available spray gun and a roller and/or spray nozzle has been unavailable. Such an extendable handle, which utilizes a spray gun, a spray nozzle, and is adaptable to any size roller, from a small sized roller, to a medium sized roller, to a large and/or elongated roller, has not been available. Yet, such an apparatus is needed in the art.

In painting many industrial and commercial surfaces and buildings, most of these kinds of structures contain many three dimensional objects or angles which are difficult to paint, i.e., that require more than one motion by an operator, or "pass" (the terms "motion" and "pass" being used interchangeably herein) with a spray gun to completely cover all angles and surfaces of such objects. Such objects therefore require more time and labor than a simple flat surface. Further, objects such as, but not by way of limitation, floor to ceiling pipes, or pipes which run parallel to a ceiling, and contoured surfaces, such as surfaces having multiple concavities and/or convexities, require multiple passes over the objects and/or surfaces to completely coat the object with paint. Such objects and surfaces are both time consuming to paint, and labor intensive.

Spray nozzles are known in the art. Spray nozzles combining two or more spraying ends, said ends which are adjustable to swivel in two or more planes, are desirable, since it may be desirable to adjust each spraying end at an angle oblique to at least one other spraying end of the spray nozzle. Therefore, it would be desirable to have a spray nozzle adapted to be connected to a spray gun which utilizes a plurality of spraying ends, said plurality of spray ends which are pivotal and which attach to pivoting arms, said pivotal arms capable of pivoting in two directions, thereby permitting adjustment by an operator of both the angle of the spray and the location of the spray, thereby permitting overlapping spray patterns to permit complete coating of an object or surface, or a roller, by a paint composition. Such an apparatus reduces both time and labor required for painting such objects or surfaces.

There is a need felt within the art for an apparatus which combines the advantages of spray nozzles, spray guns, rollers and extension handles which permit a spray gun to be connected to the lower end of the extension handle, a slidable extension portion, and an upper dual holder portion which permits the use of a spray nozzle to be connected to the upper end thereof and/or a paint roller. A connecting hose extends from the outlet end of the spray gun to the inlet end of a spray nozzle. Such a spray nozzle receives paint from the spray gun and the connecting hose attached thereto and ejects a spray of paint onto the surface and/or item to being painted, the roller, or both. A roller may be connected thereto, permitting the paint sprayed thereon and/or onto the surface/item to be rolled out, or on both the roller and the surface/item, to achieve the desired even coating or surface effect. The extension handle may be adjusted by lengthening or shortening the handle, thereby permitting the painter to paint well beyond his reach, without having to stop and apply more paint to a roller end or paint brush. Further, this extension handle permits the painter to use a spray gun and a spray nozzle as part of the extension, again more efficiently applying paint to said surface/item, including unusual contoured surfaces or items, or those surfaces/items having cracks, crevices, and the like. It will be appreciated therefore that this apparatus will reduce the time in painting a selected surface/item, thereby reducing labor costs.

An objective of the present invention is to provide a spray nozzle permitting an adjustable and broader spray pattern to facilitate more rapid paint coverage of flat or non-contoured surfaces. It is a further object of the present invention to provide a handle extension which selectively lengthens and shortens, and which permits a spray gun to be mounted in the lower end, a spray nozzle to be connected to the upper end, and the spray nozzle to be connected to the spray gun via a connecting hose, the extension handle further permitting a roller to be connected to the upper end as well.

BRIEF DESCRIPTION OF THE DRAWINGS

Other objects, features and advantages of the present invention will become more fully apparent from the following detailed descriptions of the preferred embodiments, the appended claims and the accompanying drawings in which:

DESCRIPTION OF THE PREFERRED EMBODIMENTS

Figure 1:
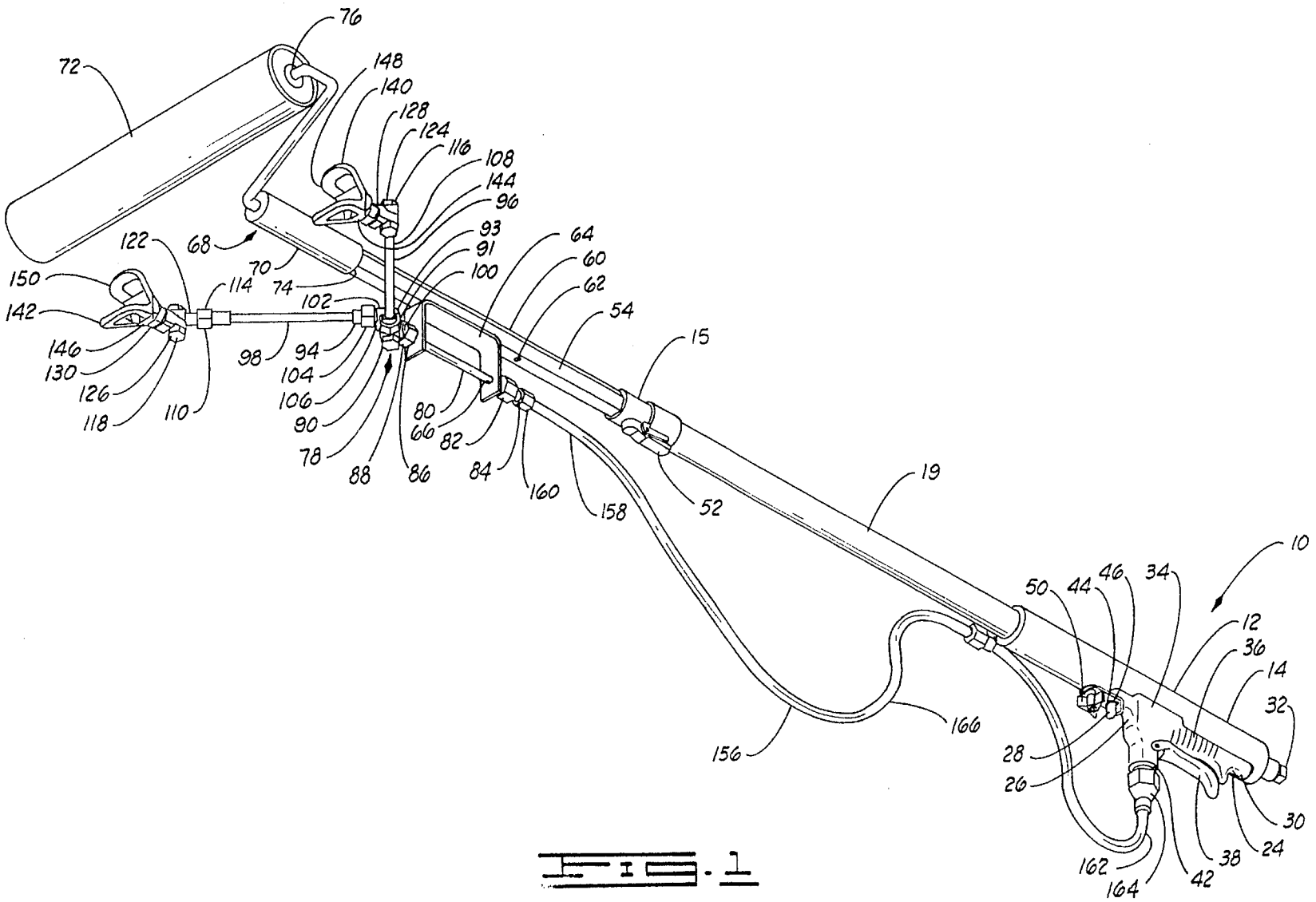
FIG. 1 is a perspective view of the painting apparatus, showing the extension handle, the spray gun, the connecting hose, the lengthening/shortening element, the connecting hose, the spray nozzle, and the roller, all constructed in accordance with the present invention.

The Embodiments and Methods of FIGS. 1–5

The present invention is directed to painting apparatus, particularly, spray nozzles, handle extensions, and methods of combining spray nozzles, handle extensions, rollers and spray guns to paint flat or contoured surfaces. It will be appreciated, however, that the painting apparatus of the present invention has applications which extend to the application of a number of different compositions, and the application of these differing compositions to a number of different surfaces and/or items, including, but not limited to, agricultural and/or horticultural applications (irrigation of crops and/or plants in greenhouses), administration of insecticides, pesticides, herbicides, and the like, and the mechanical washing and/or cleaning of items, such as automobiles, sides of houses, concrete structures, and the like. It will be appreciated that additional applications of the apparatus of the present invention will suggest themselves to those having ordinary skill in the art.

One problem with currently existing painting equipment is that various items of equipment must be utilized depending upon the contours of the surface. Further, when a surface has contours, that is, for example, but not by way of limitation, concavities, convexities, crevasses, and the like, a single application of a composition, such as paint, is frequently incomplete. That is, a single application incompletely covers the item or surface. Therefore, the operator must frequently pass over at least some portions of the item or surface two or more times to completely, evenly cover or coat the item or surface with the composition. Obviously, such a procedure is both time consuming and labor intensive.

The present invention contemplates a painting apparatus which is adaptable for painting flat surfaces or contoured surfaces. The spray nozzle element of the painting apparatus has a plurality of pivotal arms, each pivotal arm having an adjustable spray end (also termed "spray tip" herein). Each pivotal arm pivots on two planes, and each spray tip on each pivotal arm also pivots, which permits a painter (hereinafter termed "operator" herein) to set each of the pivotal arms and pivotal spray tips at a wide variety of angles, thereby permitting spray painting at a wide variety of angles, including oblique angles. This feature permits the coating or coverage by a composition sprayed upon a flat surface or item, permits some overlapping of the sprayed composition to achieve an even coating of a composition with a single pass over an item or surface, and permits even and complete coverage by the composition when sprayed upon items or surfaces having, cracks, crevices, concavities, convexities, or other variations in their surface.

Therefore spray painting of difficult, contoured surfaces, even surfaces beyond the reach of the operator, becomes readily feasible. This is also due to the extension handle, which permits the operator to reach otherwise unreachable surfaces, and to roll the sprayed surface with a roller, when desired, to achieve a desired surface effect. A roller is also used to coat a surface/item and reduce the amount of paint required to evenly and thoroughly coat the surface/item.

The present painting apparatus reduces the time required to apply a substance, such as paint, to a surface or item. Further, such broad coating of items or surfaces in one pass, or only a few passes, reduces the amount of personnel required to paint a large item or surface.

Figure 2:
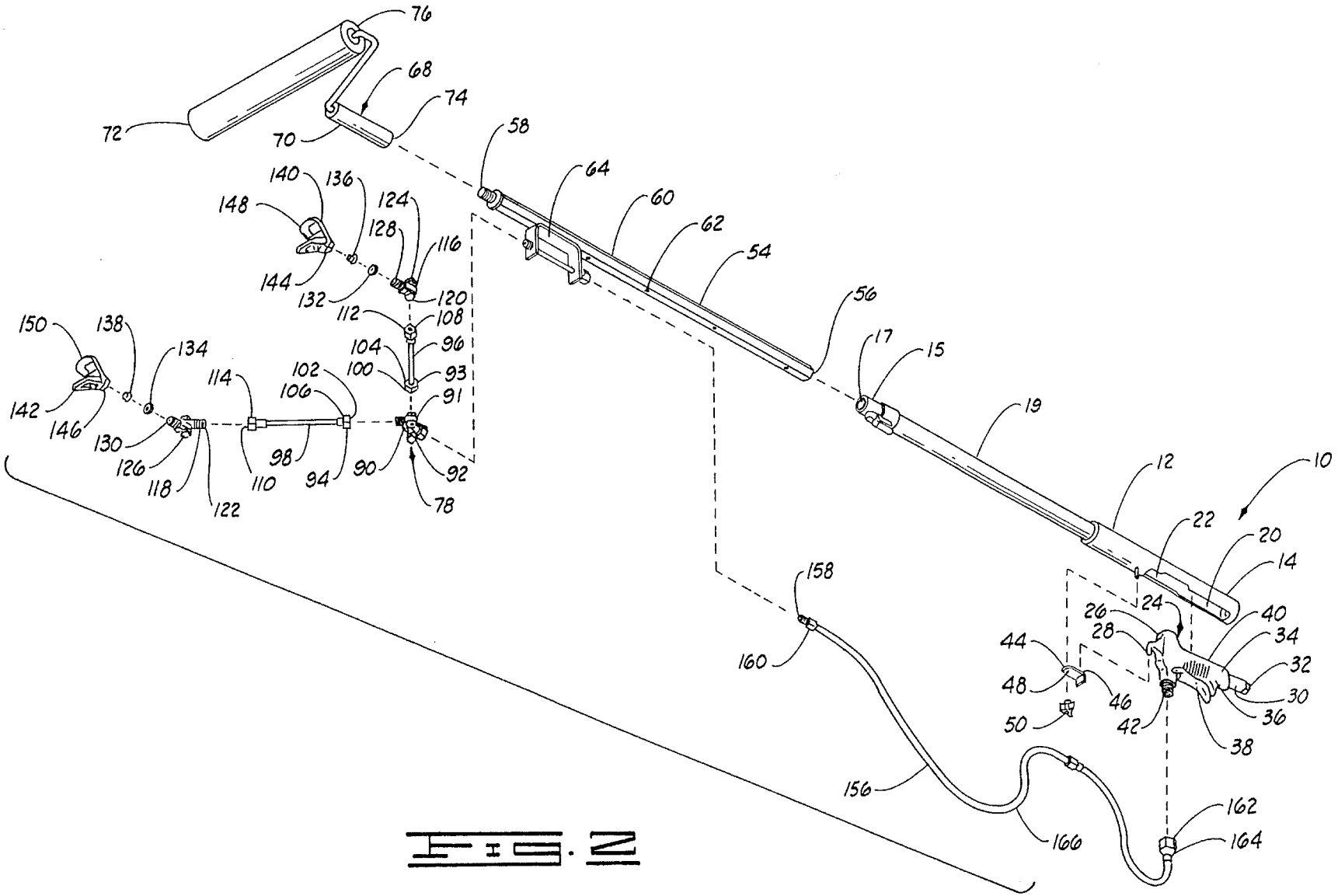
FIG. 2 is an exploded top plan view of the painting apparatus shown in FIG. 1.

Referring now to FIGS. 1–2, designated generally by the reference numeral 10 is a painting apparatus which is constructed in accordance with the present invention. The painting apparatus 10 comprises an elongated extension handle 12 having a handle end 14 and an extension end 15. The extension end 15 has an extension opening 16 therein forming an inner periphery 17 and a retaining area 18. The extension handle 12 has an outer periphery 19 as well. Near the handle end 14 is a handle opening 20 which forms a spray gun retaining space 22 sized to receive at least a portion of a standard, commercially available spray gun 24.

The spray gun 24 has an upper end 26 which comprises in part a flange portion 28, a lower end 30 which comprises in part a paint receiving inlet 32. The spray gun 24 has an outer periphery 34 which comprises a handle 36, having on one side a trigger portion 38 and on the opposing side a smooth portion 40. A spray outlet 42 is located just below the flange portion 28. In operation, a hose extends from a paint spraying system (hose and paint spraying system not shown) and is connected to the lower end 30 and the paint receiving inlet 32 of the spray gun. Paint is received into the spray gun 24 in a retaining space (not shown) and ejected via the spray outlet 42.

The spray gun 24 is disposed at least partially in the spray gun receiving space 22 of the extension handle 12 such that primarily only the smooth portion 40 is in the spray gun is retained the spray gun receiving space 22. The lower end 30 and the paint receiving inlet 32 of the spray gun 24 extending through an aperture (not shown) in the handle end of the extension handle 12. The majority of the spray gun 24, including the handle 36, and the trigger portion 38, the spray outlet 42 are exposed.

A connecting bracket 44 having a flange aperture 46 in one end thereof and a connector aperture 48 in the opposite end is disposed such that the flange portion 28 of the spray gun 24 is disposed through the flange aperture 28. A connecting element 48 is disposed through the connector aperture and connects directly to the extension handle 12. "Connecting element", as used herein, means any screw, bolt, snap, or any other means known in the art to provide a securable yet releasable connection between a bracket and a surface, such as, but not by way of limitation the handle extension 12 shown herein.

Near the extension end 15 of the extension handle 12 is an adjusting element 52 which permits adjustment of an extension rod 54 when such an extension rod 54 is disposed in the extension opening 16 and retaining area 18. It will be appreciated that the retaining area 18 is sized to slideably receive an extension rod 54, said rod 54 being shown disposed in the retaining space 18, and being connected to the extension handle 12 via the adjusting element 52. "Adjusting element" 52 means any element, such as a clamp, an element having a spoke (not shown) which fits into a correspondingly sized aperture on the extension rod 54, as shown in FIGS. 1–2, a screw, a bolt, or any other element or means known in the art which would permit an adjustable connection which is releasable between the extension handle 12 and the extension rod 54.

As shown in FIG. 1, the extension rod 54 is disposed in retaining space 18 of the extension handle 12, its length being adjusted, that is, lengthened or shortened, by the adjusting element 52. The extension rod 54 comprises a first end 56, a threaded second end 58, and an outer periphery 60. When the adjusting element 52 comprises an element having a spoke (said spoke not shown), such as is suggested in FIGS. 1–2, a plurality of correspondingly-sized apertures 62 are provided on the outer periphery 60 of the extension rod 54 to permit such lengthening and shortening. Near the threaded second end 58 of the extension rod 54 is a mounting bracket 64. The mounting bracket 64 permits a spray nozzle, as described in detail below, to be connected thereto. The mounting bracket 64 has apertures 66 through which at least a portion of the spray nozzle may be inserted. It will be appreciated, however, that the mounting bracket 64 may be provided so that at least a portion of the spray nozzle may be connectably yet readily releasably attached thereto. Such connectable but releasable means are known in the art. As such, any connectable but releasable means to firmly hold a spray nozzle to an extension rod 54 may be utilized.

A roller assembly 68 comprising a handle 70 and a roller 72 is connected to the threaded second end 58 of the extension rod 54. The handle 70 has a connecting end 74 and a roller attachment end 76. The roller 72 slideably connects onto the roller attachment end 76.

The spray nozzle 78 comprises a base 80 having a first end 82 comprising an inlet conduit 84 and a second end 86 comprising an outlet conduit 88. Connected to the second end 86 and the outlet conduit 88 is a dual base swivel 90. The dual base swivel 90 comprises a first swivel component 91 having an attached first turning component 92. The dual base swivel also comprises a second swivel component 93 with an attached second turning component 94.

A first and second pivotal arms 96 and 98, respectively, are utilized. Each first and second pivotal arms 96 and 98 each have a first end 100 and 102, respectively. The first end 100 and 102 of the respective first and second pivotal arms 96 and 98 have a first connector 104 and 106, respectively. Each first and second pivotal arm 96 and 98 have a respective second end 108 and 110. The respective second ends 108 and 110 of the first and second pivotal arms 96 and 98, respectively, have a second connector 112 and 114.

The first pivotal arm 96 is connected to the dual base swivel 90 via a connection between the first end 100 and the first turning component 92. The second pivotal arm 98 is, similarly, connected to the dual base swivel 90 via a connection between the first end 102 and the first connector 106 thereon and the second turning component 94.

The second ends 108 and 110, respectively, of the first and second pivotal arms 96 and 98 are connected via the second connectors 112 and 114, respectively, to the first and second swivel adapters 116 and 118. The first and second swivel adapters 116 and 118 have first ends 120 and 122, respectively. Each first and second swivel adapter 116 and 118, has respective first and second swivel components 124 and 126. And the first and second swivel adapters 116 and 118 each have a second end 128 and 130, respectively.

Immediately adjacent the second ends 128 and 130 of the first and second swivel adapters 116 and 118, respectively, are the first filter boss 132 and the second filter boss 134. The first and second filter bosses 132 and 134, respectively, permit a degree of filtering of the composition before the composition reaches the first and second spray tips. Located directly adjacent each first and second filter boss 132 and 134, are respective first and second spray tips 136 and 138. To hold both the first filter boss 132 and the first spray tip 136 adjacent the second end 128 of the first swivel adapter 116, a first spray housing 140 is provided. Similarly, to hold both the second filter boss 134 and second spray tip 138 adjacent the second end 130 of the second swivel adapter 118, a second spray housing 142 is provided. The first and second spray housings 140 and 142, respectively, have first connecting ends 144 and 146, and safety guards 148 and 150. The first and second spray housings 140 and 142 each having an opening 152 and 154, respectively, sized to accommodate both the filter bosses 132 and 134 and the spray tips 136 and 138 which are adjacent the second ends 128 and 130, respectively of the respective first and second swivel adapter 116 and 118. It will be appreciated that the first and second spray housings 140 and 142, respectively, have an ejection opening (not shown) for ejecting a composition. It will also be understood that the first and second safety guards 148 and 150, respectively, permit additional control and direction of the spray of the composition as the composition is ejected in spray form through the first and second spray tips 136 and 138, respectively, through the respective first and second spray housing 140 and 142 and through the first and second safety guards 148 and 150.

Further, it will be appreciated that the first and second spray tips 136 and 138, respectively, determine the spray pattern, or "fan" of the spray of composition which emerges from the spray tips. It will be understood that different spray tips permit different patterns or "fans" (the foregoing terms used interchangeably herein) of the composition when the composition is sprayed on a surface or item.

A connecting hose 156 having an upper end 158, and an upper connector 160 and a lower end 162 and a lower connector 164, a hose portion 166 extending between the upper end 158/upper connector 160 and the lower end 162/lower connector 164 is provided. The lower end 162 via the lower connector 164 is connected to the spray outlet 42 of the spray gun 24. The upper end 158 via the upper connector 160 is connected to the first end 82 and inlet conduit 84 of the base 80 of the spray nozzle 78.

The connecting hose 156 permits a composition, such as, but not by way of limitation, paint, to flow into the paint receiving inlet 32 of the spray gun 24 and through the spray outlet 42 into the connecting hose 156 and into the inlet conduit 84 of the base 80 of the spray nozzle 78 from the connecting hose 156, the composition flowing through the outlet conduit 88 and into the various components described in detail above, including, but not limited to, the first and second pivotal arms 96 and 98, respectively, the composition being ejected through the first and second spray tips 136 and 138 (the terms "spray tip," and "nozzle" are used interchangeably herein).

All swivel components, that is, the dual base swivel 90, the first and second swivel components 91 and 93, respectively, and the first and second swivels 124 and 126 of the first and second swivel adapters 116 and 118, respectively, are Titan components. The first and second pivotal arms 96 and 98, respectively, are also Titan components, and these components are available from Titan Tool Company, 107 Bauer Dr., Oakland, N.J. 07436. All spray tip and spray housing components shown and described herein (first and second spray tips 136 and 138, respectively; first and second spray housings 140 and 142, respectively) are available from GRACO, Inc., P.O. Box 1441, Minneapolis, Minn. 55440-1441.

It will be appreciated that all components of the spray nozzle 78 described in detail above, permit a composition to flow from the inlet conduit 84 into and through all above-recited components. Said composition is ejected in a spray or mist form of the composition through the first and second spray tips 136 and 138, respectively, and through the first and second spray housings 140 and 142, respectively, and onto the selected item and/or surface.

Figure 3:
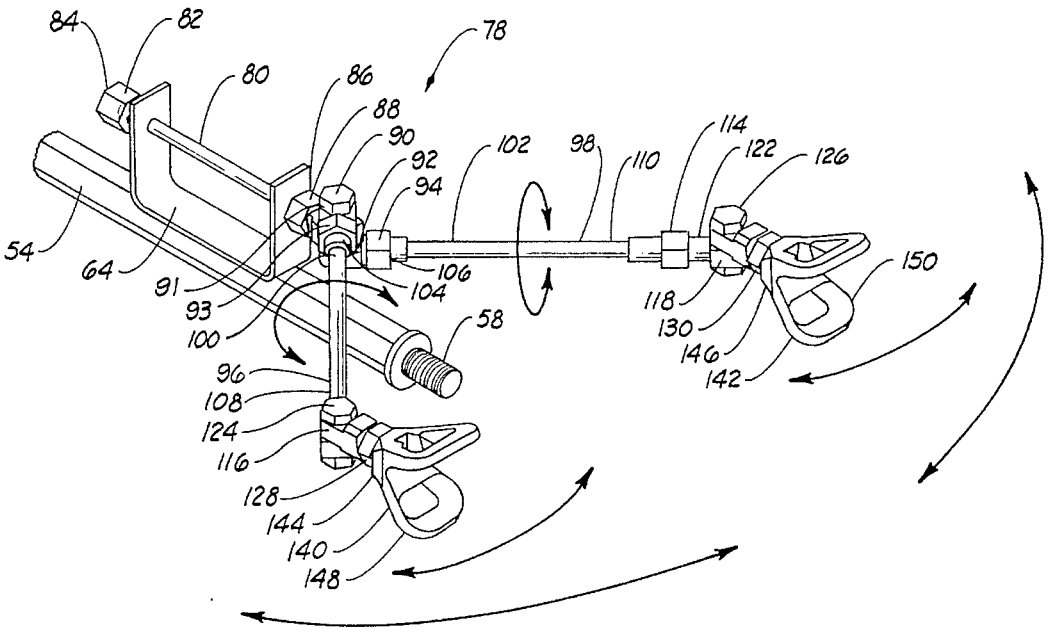
FIG. 3 is a perspective view of the spray nozzle shown in FIGS. 1–2, but showing the pivotal possibilities of various elements of the spray nozzle.

Turning to FIG. 3, the dual base swivel permits the respective first and second swivel components 91 and 93 (and therefor the first and second pivotal arms 96 and 98, respectively, and all components connected to each) to swivel, or pivot, in a fixed plane, in a range of about 300 to about 340 degree radius, as shown schematically in FIG. 3. The first and second turning components 92 and 94, which the first and second pivotal arms 96 and 98, respectively, are directly connected, permit the first and second pivotal arms to rotate, or turn, in a range of about 360 degrees, as is schematically shown in FIG. 3. The first and second swivel adapters 116 and 118, respectively, connected to the second ends 108 and 110, respectively via the second connectors 112 and 114, of the respective first and second pivotal arms 96 and 98 also permit the first and second spray housings 140 and 142 and the respective first and second spray tips 136 and 138 contained, respectively, therein, to swivel in a range of about 300 to about 340 degree radius. The respective second connectors 112 and 114, on the second ends 108 and 110, respectively, or the first and second pivotal arms are adjustable, and permit the first and second swivel adapters 116 and 118 to be turned, in a range of about a 360 degree radius. Further, although not shown, it will be appreciated that additional swivel adapters (such as the first and second swivel adapters 116 and 118) may be utilized and placed in a position on the first and second pivotal arms 96 and 98, respectively, thereby permitting at least the second ends 108 and 110 of the respective first and second pivotal arms 96 and 98 to pivot in a plane differing from the plane created by the first and second swivel components 91 and 93, respectively. It will be appreciated that such additional swivel adapters may be placed along any portion of the first and second pivotal arms 96 and 98. It will also be appreciated that more than two pivotal arms may be provided by the spray nozzle 78, additional pivotal arms having the same characteristics and components as those described previously for the first and second pivotal arms 96 and 98.

The term "swivel" as used herein means the movement of at least one component part which permits that component part to pivot in a radius in a range of degrees, such as, but not by way of limitation, a pivotal movement within a range of about 1 degree to about 360 degrees. It will be appreciated that the terms "swivel" and "pivot" are used interchangeably herein. The swivel or pivot of the components described above permits an operator to have a great deal of control over the spray of the composition upon a surface or item, or an the roller 72 or the roller assembly 68.

It will be further appreciated that the amount of flow through the first and second spray tips 136 and 138 may be controlled by controlling the size and/or shape of the opening in a particular spray tip. Alternatively, the amount of flow through the foregoing-stated spray tips could be modified, in each spray tip if desired, by utilizing, for example, but not by way of limitation, a filter, the filter being inserted so that the flow of the composition through a spray tip would be at least somewhat impeded. Such a filter would be inserted adjacent to, or in place of, the first and/or second filter bosses 132 and 134. In a further alternative, the flow of the composition through a spray tip could also be impeded by inserting a washer having a smaller diameter aperture in the same locations as the first and/or second filter bosses 132 and 134, thereby somewhat impeding the flow of the composition through the spray tips. In still a further alternative, the flow of the composition through a spray tip could be stopped completely by inserting a solid washer into the same position occupied by the first and/or second filter bosses 132 and 134, respectively, or into other obvious locations. In this manner, one or more sprays of composition from, for example, but not by way of limitation, the first pivotal arm 96 could be eliminated for a selected time.

The spray nozzle 78 is constructed generally from metal. It will be appreciated by those having ordinary skill in the art that metal, plastic, nylon, vinyl, or any combination thereof, may be utilized to construct the spray nozzle 78, or any component, combination of components, or portions of a single component thereof. Similarly, all components described herein as a part of the painting apparatus 10 are generally constructed from metal, although plastic, nylon, vinyl, or any combinations thereof may be utilized. Exceptions exist in the connecting hose 156, the roller 72, and the first and second filter bosses 132 and 134. The connecting hose will be made from rubber, but could comprise at least in part metal, plastic, nylon or vinyl. The roller 72 is usually made from a natural or synthetic fiber. The first and second filter bosses 132 and 134 are frequently made from nylon.

The painting apparatus 10 is capable of spraying a variety of different compositions. The painting apparatus 10 may also be adaptable to spray various other elements, such as, for example, but not by way of limitation, chemicals, and the like. The painting apparatus 10 is adaptable to spray, or is modifiable in a manner currently known in the art to spray, include, but not by way of limitation, paint, water, liquids, chemicals, (such as, but not by way of limitation, insecticides, pesticides, herbicides, and the like), natural substances or compositions, or any combination of the foregoing. It will be appreciated that additional substances or compositions which could be utilized to be sprayed by the painting apparatus 10 will suggest themselves to those having ordinary skill in the art.

The painting apparatus 10 as illustrated in FIGS. 1–5 is shown as being of one general size. It will be understood, however, that the painting apparatus 10 may be constructed so that the painting apparatus 10, or any element or component thereof, is larger than the painting apparatus 10 schematically illustrated herein in FIGS. 1–5. Similarly, the painting apparatus 10 may be constructed so that the painting apparatus, or any element or component thereof, is smaller than the painting apparatus 10 disclosed and shown herein.

As will be apparent to those having ordinary skill in the art, the items and surfaces requiring covering by a composition, such as a paint composition, and the nature of the composition, will define the size of the painting apparatus 10, as will the weight of the painting apparatus 10 and the pressure used to spray the composition from a paint system (not shown), through an attached paint hose (not shown) to the paint receiving inlet 32 of the spray gun 24, and from the spray gun 24 through the connecting hose 156 and through the spray nozzle 78 (via the first and second spray tips 136 and 138 and the respective first and second spray housings 140 and 142) and onto the selected surface or item.

In a general method of use for spraying a paint composition 168 onto a surface and/or item (FIGS. 1 and 3–5), a painting apparatus 10 is provided. A spray gun 24 is disposed in the spray gun receiving space 22 of the extension handle 12 as described above and illustrated in FIGS. 1–2. The spray gun 24 is connected to a painting system (having paint, a pump to move said paint, and a hose to pump said paint through). The painting system hose 170 is connected to the lower end 30 and the paint receiving inlet 32 of the spray gun 24 in a manner known in the art. In one embodiment a spray gun 24 comprising a filter gun having an in-line gun filter (not shown) is utilized.

Figure 4:
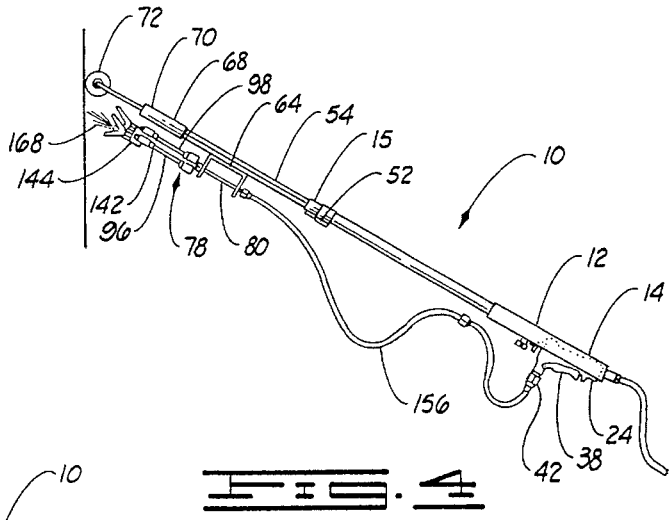
FIG. 4 is a side elevational view of the painting apparatus of FIGS. 1–2 showing paint being applied via the spray nozzle directly to a surface, said surface being rolled by a roller.
Figure 5:
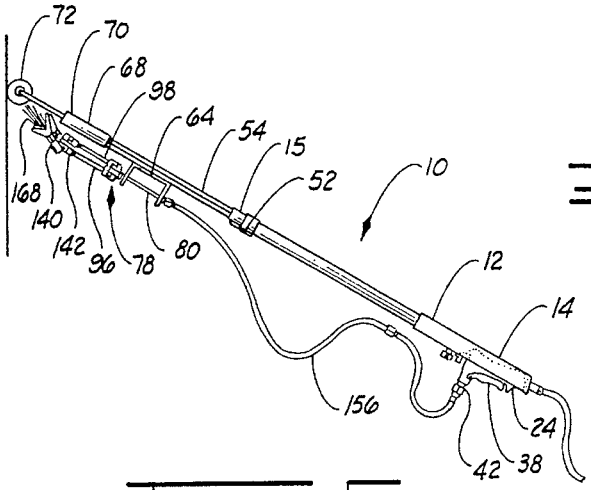
FIG. 5 is a side elevational view of the painting apparatus of FIGS. 1–2 showing paint being applied via the spray nozzle directly to the roller, the roller rolling the paint onto a surface.

An operator (not shown) adjusts a number of components before beginning the painting operation. The operator adjusts the extension rod 54 by lengthening the extension rod 54 or shortening the extension rod 54 via the adjusting element 52 on the extension end 15 of the extension handle 12, as desired. After the operator adjusts the first and second swivel components 91 and 93, the first and second turning components 92 and 94, the first and second pivotal arms 96 and 98, the second connectors 112 and 114 of the first and second pivotal arms, and the first and second swivel adapters 116 and 118, the operator is ready to activate the pump assembly and begin painting. In making the foregoing adjustments, the operator may adjust the spray nozzle 78 to spray the paint composition onto the surface or item being painted, as shown in FIG. 4. Alternatively, the operator may adjust the spray nozzle 78 to spray the paint composition onto the roller 72. In yet a further alternative, the operator may adjust the spray nozzle to spray the paint composition onto both the roller 72 and the surface.

The operator activates the pump system, thereby causing the paint composition to be under pressure and to be therefore moved via the pump through the pump system and pump hose 170 to the spray gun 24. The operator holds the spray gun handle end 14 of the extension handle 12 and depresses the trigger portion 38 of the spray gun 24, thereby causing a flow of the paint composition 168 therethrough. The paint composition 168 flows through the connecting hose 156 and into the first end 82 of the spray gun via the inlet conduit 84. The paint composition 168 flows through the base 80 of the spray nozzle 78 and all components described therein, through the first and second pivotal arms 96 and 98, respectively, and all components described therein, through the first and second swivel adapters 116 and 118, respectively, and all components described therein, and through the respective first and second spray tips 136 and 138, and the respective spray housings 140 and 142, and all components described therein, the paint composition 168 exiting in the form of a spray or a mist of the paint composition 168 which is disposed upon the surface or item being painted (FIG. 4), the roller (FIG. 5), or both (not shown), in a manner predetermined by the operator, based upon the adjustment of the components of the painting apparatus 10 as described above, as well as by other foregoing options, such as the need to paint corners, cracks, crevices, or other contours, or the need to provide a specific effect on the surface being painted, which have been described in detail herein previously. In spraying a paint composition 168 on an item or surface, the operator overlaps the resulting paint composition 168 spray streams from each spray tip, the overlap being in a range of about 0.5 to about 10 inches, a preferred overlap being in the range of about 1 to about 4 inches. It will be appreciated, however, that the amount of overlap is determined by the irregularities and contours of the surface or item being spray painted, and the desired degree of coverage by the paint composition.

The operator rolls the paint composition 168 on the surface or item by moving the painting apparatus 10 up and down while pressing the roller 72 firmly against said surface or item in a manner which is known in the art. In this manner, the operator may provide a paint composition 168 to a surface which is far beyond his reach, or may be able to provide a paint composition 168 to corners, cracks, crevices, and other surface irregularities or contours which are both within a normal operator's reach and beyond normal reach. Therefore, scaffolding and/or ladders become unnecessary, or, alternatively, their use is greatly limited, and the operator is provided greater safety by being able to stay on a regular floor surface, as opposed to standing on scaffolding or ladders.

In some methods of use, the roller assembly 68 will be removed, and the painting apparatus 10 will be operated with the spray nozzle 78 alone. In this instance, it will be appreciated that the first and second swivel adapters 116 and 118 may be rotated toward each other such that the spray or mist is directed inward. This positioning is desirable when painting door frames, vertical or horizontal columns, and other three dimensional items and/or surfaces. It will be appreciated, however, that the first and second swivel adapters 116 and 118, as well as the first and second pivotal arms 96 and 98 may be adjusted such that the spray nozzle 78 directs the paint composition 168 to be sprayed in any direction. In a further alternative (not shown), the spray gun 24 is removed from the extension handle of the painting apparatus and used separately. The spray nozzle 78 is connected directly, via any connector shown and/or described herein, or known in the art, to the spray outlet 42 of the spray gun 24, and the spray gun 24 and spray nozzle 78 are utilized in any manner or method shown and/or described herein, or known in the art. The spray gun 78 may be connected to the spray outlet 42 of the spray gun via the first end 82 of the base 80. Alternatively, however, the base may be removed, and the spray gun 78 may be connected to the spray outlet of the spray gun via a connector which engages the dual swivel base 90 of the spray nozzle 78. As will be appreciated, any connector shown and/or described herein, or known in the art may be utilized to facilitate this connection.

It will be understood that all components of the painting apparatus 10 are easily and readily manipulated by the operator. The operator needs only one hand to trigger the spray gun 24, thereby triggering a spray or mist of paint composition 168 from the spray nozzle 78 connected thereto, while using the other hand to hold and manipulate the extension handle 12, as described above and illustrated herein. The painting apparatus 10 is of a weight light enough to be easily moveable by the operator using a both hands.

Changes may be made in the embodiments of the invention described herein, or in parts or elements of the embodiments described herein, or in the sequence of steps of the methods described herein, without departing from the spirit and/or scope of the invention as defined in the following claims.

What is claimed is:

1. A painting apparatus adapted for use with a spray gun having a spray outlet, said painting apparatus comprising:

a handle having a handle end, an extension end and an outer periphery, an opening intersecting a portion of the handle end forming a spray gun receiving space, the spray gun being disposed in the spray gun receiving space;

an extension means which slideably lengthens and shortens having adjusting means, the extension means connected to the handle at the extension end, the extension means having both a mounting means for a spray nozzle and a connecting means for a roller assembly;

a spray nozzle comprising a base having a single inlet means and an inlet conduit formed in the base, said inlet conduit connected to a plurality of pivotally adjustable outlet means, wherein each of the plurality of pivotally adjustable outlet means has a pivotal means contained therein, said pivotally adjustable outlet means pivotally connected to the base, and wherein each of the plurality of pivotally adjustable outlet means further comprises a discharge means, wherein the connection of the base, the plurality of pivotally adjustable outlet means, and the discharge means permit a flow of a composition therethrough for discharge via the discharge means upon a selected surface when said composition is introduced into the single inlet means;

a roller assembly connected to the connecting means of the extension, the roller assembly comprising a roller;

a connecting hose which connects to the spray outlet of the spray gun and extends to and connects to the single inlet means of the base of the spray nozzle;

wherein a flow of a composition from the spray gun through the spray outlet, the connecting hose, and the discharge means of the spray nozzle permits a spray of the composition on a selected surface; and wherein each of the plurality of pivotally adjustable outlet means of the spray nozzle is adjustable to permit the spray of the composition through the discharge means onto the selected surface selected from the group consisting of a roller, a surface, and both a roller and a surface.

2. A method for using a painting apparatus adapted for use with a spray gun having a spray outlet, said method comprising the steps of:

providing a surface or item;

providing a painting apparatus, comprising a handle having a handle end, an extension end and an outer periphery, an opening intersecting a portion of the handle end forming a spray gun receiving space, the spray gun being disposed in the spray gun receiving space;

an extension means which slideably lengthens and shortens having adjusting means, the extension means connected to the handle at the extension end, the extension means having both a mounting means for a spray nozzle and a connecting means for a roller assembly;

a spray nozzle comprising a base having a single inlet means and an inlet conduit formed in the base, said inlet conduit connected to a plurality of pivotally adjustable outlet means, wherein each of the plurality of pivotally adjustable outlet means has a pivotal means contained therein, said pivotally adjustable outlet means pivotally connected to the base, and wherein each of the plurality of pivotally adjustable outlet means further comprises a discharge means, wherein the connection of the base, the plurality of pivotally adjustable outlet means, and the discharge means permit a flow of a composition therethrough for discharge via the discharge means upon a selected surface when said composition is introduced into the single inlet means;

a roller assembly connected to the connecting means of the extension, the roller assembly comprising a roller;

a connecting hose which connects to the spray outlet of the spray gun and extends to and connects to the single inlet means of the base of the spray nozzle;

wherein a flow of a composition from the spray gun through the spray outlet, the connecting hose, and the discharge means of the spray nozzle permits a spray of the composition on a selected surface; and wherein each of the plurality of pivotally adjustable outlet means of the spray nozzle is adjustable to permit the spray of the composition through the discharge means onto the selected surface selected from the group consisting of a roller, a surface, and both a roller and a surface;

adjusting extension means such that the spray nozzle is extended a distance on the extension means from the spray gun;

choosing one or more selected surface upon which to dispose the composition;

adjusting the pivotally adjustable outlet means of the spray nozzle of the painting apparatus such that the one or more selected surface will be covered by the composition when the composition is discharged from the discharge means of the painting apparatus;

causing a composition to flow into and through the spray gun and into and through the spray nozzle, the composition emerging from the spray nozzle in a predetermined specific discharge; and covering the item or surface with the composition by spraying the composition thereon in the predetermined specific discharge pattern.

3. A painting apparatus adapted for use with a spray gun having a spray outlet, said painting apparatus comprising:

a handle having a handle end, an extension end and an outer periphery, an opening intersecting a portion of the handle end forming a spray gun receiving space, the spray gun being disposed in the spray gun receiving space;

an extension means which slideably lengthens and shortens having adjusting means, the extension means connected to the handle at the extension end, the extension means having both a mounting means for a spray nozzle and a connecting means for a roller assembly;

a spray nozzle comprising a base having a single inlet means and an inlet conduit formed in the base, said inlet conduit connected to a plurality of pivotally adjustable outlet means, wherein each of the plurality of pivotally adjustable outlet means has a pivotal means contained therein, said pivotally adjustable outlet means pivotally connected to the base, and wherein each of the plurality of pivotally adjustable outlet means further comprises a discharge means, wherein the connection of the base, the plurality of pivotally adjustable outlet means, and the discharge means permit a flow of a composition therethrough for discharge via the discharge means upon a selected surface when said composition is introduced into the single inlet means;

a roller assembly connected to the connecting means of the extension, the roller assembly comprising a roller;

a connecting hose which connects to the spray outlet of the spray gun and extends to and connects to the single inlet means of the base of the spray nozzle;

wherein a flow of a composition from the spray gun through the spray outlet, the connecting hose, and the discharge means of the spray nozzle permits a spray of the composition on a selected surface; and wherein each of the plurality of pivotally adjustable outlet means of the spray nozzle is adjustable to permit a spray of the composition through the discharge means onto both the selected surface and the roller.

4. A method for using a painting apparatus adapted for use with a spray gun having a spray outlet, said method comprising the steps of:

providing a surface or item;

providing a painting apparatus, comprising a handle having a handle end, an extension end and an outer periphery, an opening intersecting a portion of the handle end forming a spray gun receiving space, the spray gun being disposed in the spray gun receiving space;

an extension means which slideably lengthens and shortens having adjusting means, the extension means connected to the handle at the extension end, the extension means having both a mounting means for a spray nozzle and a connecting means for a roller assembly;

a spray nozzle comprising a base having a single inlet means and an inlet conduit formed in the base, said inlet conduit connected to a plurality of pivotally adjustable outlet means, wherein each of the plurality of pivotally adjustable outlet means has a pivotal means contained therein, said pivotally adjustable outlet means pivotally connected to the base, and wherein each of the plurality of pivotally adjustable outlet means further comprises a discharge means, wherein the connection of the base, the plurality ,of pivotally adjustable outlet means, and the discharge means permit a flow of a composition therethrough for discharge via the discharge means upon a selected surface when said composition is introduced into the single inlet means;

a roller assembly connected to the connecting means of the extension, the roller assembly comprising a roller;

a connecting hose which connects to the spray outlet of the spray gun and extends to and connects to the single inlet means of the base of the spray nozzle;

wherein a flow of a composition from the spray gun through the spray outlet, the connecting hose, and the discharge means of the spray nozzle permits a spray of the composition on a selected surface; and wherein each of the plurality of pivotally adjustable outlet means of the spray nozzle is adjustable to permit a spray of the composition through the discharge means onto both the selected surface and the roller;

adjusting extension means such that the spray nozzle is extended a distance on the extension means from the spray gun;

choosing a selected surface upon which to dispose the composition;

adjusting the pivotally adjustable outlet means of the spray nozzle of the painting apparatus such that both the selected surface and the roller will be covered by the composition when the composition is discharged from the discharge means of the painting apparatus;

causing a composition to flow into and through the spray gun and into and through the spray nozzle, the composition emerging from the spray nozzle in a predetermined specific discharge; and covering the item or surface with the composition by spraying the composition thereon in the predetermined specific discharge pattern.

* * * * *